US011375825B2

(12) United States Patent
Ghanei et al.

(10) Patent No.: US 11,375,825 B2
(45) Date of Patent: Jul. 5, 2022

(54) SUPPORT CUSHIONS INCLUDING A POCKETED COIL LAYER WITH A PLURALITY OF FABRIC TYPES FOR DIRECTING AIR FLOW, AND METHODS FOR CONTROLLING SURFACE TEMPERATURE OF SAME

(71) Applicant: Sealy Technology, LLC, Trinity, NC (US)

(72) Inventors: Hamid Ghanei, Trinity, NC (US); Kevin Tar, Trinity, NC (US); Taylor M. Jansen, Trinity, NC (US); James Alva Evans, Jr., Trinity, NC (US)

(73) Assignee: SEALY TECHNOLOGY, LLC, Trinity, NC (US)

( * ) Notice: Subject to any disclaimer, the term of this patent is extended or adjusted under 35 U.S.C. 154(b) by 0 days.

(21) Appl. No.: 16/971,099

(22) PCT Filed: Feb. 21, 2019

(86) PCT No.: PCT/US2019/018961
§ 371 (c)(1),
(2) Date: Aug. 19, 2020

(87) PCT Pub. No.: WO2019/165074
PCT Pub. Date: Aug. 29, 2019

(65) Prior Publication Data

US 2020/0390248 A1 Dec. 17, 2020

Related U.S. Application Data

(60) Provisional application No. 62/633,895, filed on Feb. 22, 2018.

(51) Int. Cl.
*A47C 27/15* (2006.01)
*A47C 21/04* (2006.01)
(Continued)

(52) U.S. Cl.
CPC ..... *A47C 27/15* (2013.01); *A47C 21/042* (2013.01); *A47C 21/048* (2013.01);
(Continued)

(58) Field of Classification Search
CPC ..... A47C 27/15; A47C 27/064; A47C 27/144; A47C 27/20; A47C 27/148; A47C 27/146;
(Continued)

(56) References Cited

U.S. PATENT DOCUMENTS 1,142,876 A 6/1915 Davis et al.
3,101,488 A 8/1963 Peebles
(Continued)

FOREIGN PATENT DOCUMENTS

CA 3091349 A1 8/2020
EP 1997467 A2 12/2008
(Continued)

OTHER PUBLICATIONS

Korean Intellectual Property Office, International Search Report and Written Opinion for PCT/US2019/018961 dated Jun. 4, 2019, 12 pages.
(Continued)

*Primary Examiner* — Peter M. Cuomo
*Assistant Examiner* — Alison N Labarge
(74) *Attorney, Agent, or Firm* — Stites & Harbison, PLLC; Terry L. Wright; James R. Hayne

(57) ABSTRACT

A support cushion for providing air flow to a user resting on the support cushion is provided. The support cushion includes pocketed coil layer and a base layer positioned adjacent to and below the pocketed coil layer. The pocketed coil layer including a plurality of fabric types for directing air flow. A fan is operably connected to the inlet hole of the base layer to provide air flow into and through the pocketed
(Continued)

coil layer to a body support layer. Methods of controlling air flow through a support cushion are also provided.

18 Claims, 6 Drawing Sheets

(51) Int. Cl.
*A47C 27/06* (2006.01)
*A47C 27/14* (2006.01)
*A47C 27/20* (2006.01)

(52) U.S. Cl.
CPC ..... *A47C 27/064* (2013.01); *A47C 27/144* (2013.01); *A47C 27/20* (2013.01); *A47C 27/148* (2013.01)

(58) Field of Classification Search
CPC ... A47C 27/121; A47C 21/042; A47C 21/048; A47C 21/044; A61G 7/05784
See application file for complete search history.

(56) References Cited

U.S. PATENT DOCUMENTS 3,266,064 A * 8/1966 Figman ..... A47C 27/144 5/726
3,529,310 A 9/1970 Olmo
4,467,611 A 8/1984 Nelson et al.
4,580,301 A 4/1986 Ludman et al.
4,644,753 A 2/1987 Burke
4,922,721 A 5/1990 Robertson et al.
5,136,850 A 8/1992 Bierschenk et al.
5,171,272 A 12/1992 Recine, Sr.
5,249,826 A 10/1993 Bell
5,295,709 A 3/1994 Bell
5,315,830 A 5/1994 Doke et al.
5,367,879 A 11/1994 Doke et al.
5,367,890 A 11/1994 Doke
5,398,510 A 3/1995 Gilley et al.
5,448,788 A 9/1995 Wu
5,487,002 A 1/1996 Diller et al.
5,501,076 A 3/1996 Sharp, III et al.
5,505,046 A 4/1996 Nelson et al.
5,518,271 A 5/1996 Bell
5,522,216 A 6/1996 Park et al.
5,524,439 A 6/1996 Gallup et al.
5,557,813 A * 9/1996 Steed ..... A47C 27/001 5/678
5,576,512 A 11/1996 Doke
5,597,200 A 1/1997 Gregory et al.
5,626,021 A 5/1997 Karunasir et al.
5,650,904 A 7/1997 Gilley et al.
5,703,464 A 12/1997 Karunasir et al.
5,737,923 A 4/1998 Gilley et al.
5,860,280 A 1/1999 Recine, Sr. et al.
5,887,304 A 3/1999 von der Heyde
6,003,319 A 12/1999 Gilley et al.
6,069,581 A 5/2000 Bell et al.
6,119,463 A 9/2000 Bell
6,169,245 B1 1/2001 Sharp
6,188,011 B1 2/2001 Nolas et al.
6,207,888 B1 3/2001 Nolas
6,223,539 B1 5/2001 Bell
6,232,910 B1 5/2001 Bell et al.
6,253,401 B1 7/2001 Boyd
6,336,237 B1 1/2002 Schmid
6,269,314 B1 4/2002 Nolas
6,380,883 B1 4/2002 Bell et al.
6,399,871 B1 6/2002 Sharp
6,400,308 B1 6/2002 Bell et al.
6,425,527 B1 7/2002 Smole
6,492,585 B1 12/2002 Zamboni et al.
6,546,576 B1 4/2003 Lin
RE38,138 E 6/2003 Gallup et al.
6,606,866 B2 8/2003 Bell
6,660,925 B1 12/2003 Sharp
6,684,435 B1 2/2004 Wells
6,700,052 B2 3/2004 be
6,804,848 B1 10/2004 Rose
7,114,771 B2 10/2006 Lofy et al.
7,165,281 B2 1/2007 Larsson et al.
7,178,344 B2 2/2007 Bell
7,240,386 B1 7/2007 McKay et al.
7,475,464 B2 1/2009 Lofy et al.
7,531,739 B1 5/2009 Moczygemba
7,587,901 B2 9/2009 Petrovski
7,591,507 B2 9/2009 Giffin et al.
7,619,158 B2 11/2009 Sharp et al.
7,640,754 B2 1/2010 Wolas
7,665,803 B2 2/2010 Wolas
7,708,338 B2 5/2010 Wolas
7,763,792 B2 7/2010 Sharp et al.
RE41,765 E 9/2010 Gregory et al.
7,827,805 B2 11/2010 Comiskey et al.
7,871,847 B2 1/2011 Moczygemba
7,877,827 B2 2/2011 Marquette et al.
7,963,594 B2 6/2011 Wolas
7,966,835 B2 6/2011 Petrovski
7,996,936 B2 8/2011 Marquette et al.
8,065,763 B2 11/2011 Brykalski et al.
8,104,295 B2 1/2012 Lofy
8,143,554 B2 3/2012 Lofy
8,181,290 B2 5/2012 Brykalski et al.
8,191,187 B2 6/2012 Brykalski et al.
8,222,511 B2 7/2012 Lofy
8,256,236 B2 9/2012 Lofy
8,332,975 B2 12/2012 Brykalski et al.
8,359,871 B2 1/2013 Woods et al.
8,402,579 B2 3/2013 Marquette et al.
8,418,286 B2 4/2013 Brykalski et al.
8,434,314 B2 5/2013 Comiskey et al.
8,438,863 B2 5/2013 Lofy
RE44,272 E 6/2013 Bell
2003/0019044 A1 1/2003 Larsson et al.
2004/0079407 A1 4/2004 Sharp
2004/0261830 A1 12/2004 Sharp et al.
2006/0107989 A1 5/2006 Bierschenk et al.
2006/0124165 A1 6/2006 Bierschenk et al.
2006/0180192 A1 8/2006 Sharp et al.
2007/0056116 A1 3/2007 Galardo
2008/0028536 A1 2/2008 Hadden-Cook
2008/0047598 A1 2/2008 Lofy
2008/0072382 A1 3/2008 James
2008/0084095 A1 4/2008 Wolas
2008/0100101 A1 5/2008 Wolas
2008/0148481 A1 6/2008 Brykalski et al.
2008/0173022 A1 7/2008 Petrovski
2008/0245397 A1 10/2008 Moczygemba et al.
2009/0090409 A1 4/2009 Moczygemba
2009/0090544 A1 4/2009 Rawot et al.
2009/0093078 A1 4/2009 Moczygemba
2009/0193814 A1 8/2009 Lofy
2009/0211619 A1 8/2009 Sharp et al.
2009/0218855 A1 9/2009 Wolas
2010/0011502 A1 1/2010 Brykalski et al.
2010/0081191 A1 4/2010 Woods
2010/0146700 A1 6/2010 Wolas
2010/0019968 A1 8/2010 Woods et al.
2010/0193498 A1 8/2010 Walsh
2011/0048033 A1 3/2011 Comiskey et al.
2011/0107514 A1 5/2011 Brykalski et al.
2011/0119826 A1 5/2011 Marquette et al.
2011/0253340 A1 10/2011 Petrovski
2011/0258778 A1 10/2011 Brykalski et al.
2011/0271994 A1 11/2011 Gilley
2011/0289684 A1 12/2011 Parish et al.
2011/0296611 A1 12/2011 Marquette et al.
2011/0314837 A1 12/2011 Parish et al.
2012/0000207 A1 1/2012 Parish et al.
2012/0080911 A1 4/2012 Brykalski et al.
2012/0102658 A1* 5/2012 Mantzis ..... A47C 27/062 5/720
2012/0114512 A1 5/2012 Lofy et al.

(56) References Cited

U.S. PATENT DOCUMENTS

| | | | | |
|---|---|---|---|---|
| 2012/0131748 | A1 | 5/2012 | Brykalski et al. | |
| 2012/0227182 | A1 | 9/2012 | Brykalski et al. | |
| 2012/0261399 | A1 | 10/2012 | Lofy | |
| 2012/0305043 | A1 | 12/2012 | Kossakovski et al. | |
| 2012/0319439 | A1 | 12/2012 | Lofy | |
| 2013/0032189 | A1 | 2/2013 | Moczygemba et al. | |
| 2013/0037073 | A1 | 2/2013 | LaGrandeur et al. | |
| 2013/0059190 | A1 | 3/2013 | Kossakovski et al. | |
| 2013/0086923 | A1 | 4/2013 | Petrovski et al. | |
| 2013/0097777 | A1 | 4/2013 | Marquette et al. | |
| 2013/0146116 | A1 | 6/2013 | Jovovic et al. | |
| 2013/0186448 | A1 | 7/2013 | Ranalli et al. | |
| 2014/0189951 | A1* | 7/2014 | DeFranks | A47C 21/044 5/423 |
| 2015/0313370 | A1* | 11/2015 | Rawls-Meehan | A47C 27/14 5/423 |
| 2017/0251820 | A1* | 9/2017 | Long | A47C 27/008 |
| 2018/0049559 | A1* | 2/2018 | Jewett | A47C 27/066 |
| 2018/0140105 | A1* | 5/2018 | Spinks | A47C 31/105 |

FOREIGN PATENT DOCUMENTS

| | | | |
|---|---|---|---|
| EP | 1804616 | B1 | 2/2012 |
| JP | S55-34463 | U | 3/1980 |
| JP | H06-22829 | A | 2/1994 |
| JP | 07-313306 | | 12/1995 |
| JP | 2003-024184 | A | 1/2003 |
| JP | 2006-014819 | A | 1/2006 |
| KR | 101073761 | B1 | 10/2011 |
| KR | 20170050471 | A | 5/2017 |
| WO | 2005120295 | A1 | 12/2005 |
| WO | 2019/165074 | A1 | 8/2019 |

OTHER PUBLICATIONS

European Patent Office, Extended Search Report issued in corresponding Application No. 19756539.3 dated Oct. 11, 2021.

China National Intellectual Property Administration, Notification of First Office Action issued in corresponding Application No. 201980014654.0 dated Dec. 15, 2021.

Korean Intellectual Property Office, Notice to Submit a Response issued in corresponding Application No. 10-2020-7026848 dated Jan. 3, 2022.

United States Patent and Trademark Office, International Search Report issued in corresponding Application No. PCT/US2019/018961 dated Jun. 4, 2019.

Automotive Industry News & Analysis, Market Research—Just Auto, US: Amerigon Q3 net falls, Oct. 29, 2008.

* cited by examiner

SUPPORT CUSHIONS INCLUDING A POCKETED COIL LAYER WITH A PLURALITY OF FABRIC TYPES FOR DIRECTING AIR FLOW, AND METHODS FOR CONTROLLING SURFACE TEMPERATURE OF SAME

CLAIM TO PRIORITY

This 35 U.S.C. § 371 National Stage Patent Application claims priority to PCT Patent Application No. PCT/US2019/018961, filed Feb. 21, 2019, and titled "Support Cushions Including A Pocketed Coil Layer With A Plurality Of Fabric Types For Directing Air Flow, And Methods For Controlling Surface Temperature Of Same" which claims priority to and benefit of U.S. Provisional Patent Application Ser. No. 62/633,895, filed Feb. 22, 2018, titled "Support Cushions Including a Pocketed Coil Layer with a Plurality of Fabric Types for Directing Air Flow, And Methods for Controlling Surface Temperature of Same", and all of which is incorporated by reference herein.

TECHNICAL FIELD

The present embodiments relate to support cushions and methods for controlling the surface temperature of support cushions. In particular, the present embodiments include support cushions, such as mattress assemblies, that make use of a pocketed coil layer with a plurality of materials utilized to encase the individual coils in order to direct air to the surfaces of the support cushions.

BACKGROUND

An aspect of successful and restful sleep is individual sleep comfort. Medical research suggests that sleep deprivation ("sleep debt") can have significant negative impacts on longevity, productivity, and overall mental, emotional, and physical health. Chronic sleep debt has been linked to weight gain and, more specifically, has been observed to not only affect the way the body processes and stores carbohydrates, but has also been observed to alter hormone levels that affect appetite. Moreover, sleep debt may result in irritability, impatience, inability to concentrate, and moodiness, which has led some researchers to suggest a link between sleep debt and worksite accidents, traffic incidents, and general afternoon inattentiveness. Furthermore, sleep disorders have been linked to hypertension, increased stress hormone levels, and irregular heartbeat, and additional research has recently suggested that a lack of sleep can affect immune function, resulting in increased susceptibility to illness and disease, e.g., cancer. In all, researchers have now suggested that sleep debt has significant economic impact due to lost productivity from some of the various effects described herein. Accordingly, a support cushion that improves sleep comfort and lowers individual sleep debt would be both highly desirable and beneficial.

SUMMARY

The present embodiments include support cushions and methods for controlling air flow through the support cushions. In particular, the present embodiments include support cushions, such as mattress assemblies, that make use of a pocketed coil layer made with a plurality of fabric types to direct air to the surfaces of the support cushions. Thus, the support cushions described herein allow a user to individualize their level of comfort, including sleep comfort, by controlling the amount and/or temperature of the air flowing to the surface of the support cushions.

In one exemplary embodiment a support cushion is disclosed herein. Such a support cushion includes a body supporting layer having a first surface and a second surface opposite the first surface; a pocketed coil layer adjacent the second surface of the body supporting layer comprising a first group of pocketed coils defining a perimeter of the pocketed coil layer and a second group of pocketed coils positioned within the perimeter; a base layer positioned adjacent the pocketed coil layer; a fan operably connected through a conduit to an inlet hole of the base layer, the fan for providing air flow into the inlet hole of the base layer, where the air flow is directed from the inlet hole of the base layer into the pocketed coil layer, through the second group of pocketed coils, and into and through the body supporting layer.

In some embodiments, the first group of pocketed coils includes a first fabric that is substantially air impermeable. In other embodiments, the second group of pocketed coils includes a second fabric that is substantially air permeable. In still other embodiments, the body supporting layer defines a plurality of channels extending from the second surface to the first surface, the plurality of channels substantially aligned with the second group of pocketed coils. In some embodiments, the second group of pocketed coils are located in an interior section of the pocketed coil layer.

In some embodiments, the body supporting layer is comprised of a visco-elastic foam.

In some embodiments, the air flow is comprised of ambient air. In other embodiments, the support cushion further includes a heating unit, a cooling unit, or both a heating unit and a cooling unit configured to provide thermally controlled air flow into the inlet hole of the base layer into the pocketed coil layer, through the second fabric of the second group of pocketed coils, and into and through the body supporting layer.

In some embodiments, the support cushion further includes a third group of pocketed coils intersecting the perimeter defined by the first group of pocketed coils, where the third group of coils divides the pocketed coil layer into two zones. In other embodiments, the third group of pocketed coils laterally intersects the perimeter defined by the first group of pocketed coils, where the third group of pocketed coils includes a first fabric that is substantially air impermeable. In still other embodiments, the third group of pocketed coils longitudinally intersects the perimeter defined by the first group of pocketed coils, where the third group of pocketed coils includes a first fabric that is substantially air impermeable. In some embodiments, the support cushion further includes a fourth group of pocketed coils intersecting the perimeter defined by the first group of pocketed coils at an opposing axis to the third group of pocketed coils, where the third and fourth groups of coils include a first fabric that is substantially air impermeable and divide the pocketed coil layer into four zones.

In some embodiments, an individual pocketed coil of the first group of pocketed coils has a different diameter than an individual pocketed coil of the second group of pocketed coils. In other embodiments, the individual pocketed coil of the first group of pocketed coils has a smaller diameter than the individual pocketed coil of the second group of pocketed coils.

In another aspect, a mattress assembly is disclosed herein. Such a mattress assembly including a body supporting layer comprised of visco-elastic foam and having a first surface and a second surface opposite the first surface, the body supporting layer defining a plurality of channels extending from the second surface to the first surface; a pocketed coil layer adjacent the second surface of the body supporting layer comprising a first group of pocketed coils defining a perimeter of the pocketed coil layer and a second group of pocketed coils, where the first group of pocketed coils includes a first fabric, where the first fabric is substantially air impermeable, where the second group of pocketed coils includes a second fabric, where the second fabric is substantially air permeable; an impermeable base layer positioned adjacent the pocketed coil layer; a fan operably connected to an inlet hole of the base layer, the fan for providing air flow into the inlet hole of the base layer, where the air flow is directed from the inlet hole of the base layer into the pocketed coil layer, through the second fabric of the second group of pocketed coils, and into and through the body supporting layer.

In some embodiments, the mattress assembly further includes a third group of pocketed coils intersecting the perimeter defined by the first group of pocketed coils, where the third group of coils divides the pocketed coil layer into two sections. In some embodiments, the third group of pocketed coils laterally intersects the perimeter defined by the first group of pocketed coils. In other embodiments, the third group of pocketed coils longitudinally intersects the perimeter defined by the first group of pocket coils. In still other embodiments, the mattress assembly further includes a fourth group of pocketed coils intersecting the perimeter defined by the first group of pocketed coils at an opposing axis to the third group of pocketed coil, where the third and fourth groups of coils divide the pocketed coil layer into four sections.

In yet another aspect, a method of controlling air flow through a support cushion is disclosed herein. Such a method includes the steps of: providing a support cushion having a body supporting layer having a first surface and a second surface opposite the first surface, a pocketed coil layer adjacent the second surface of the body supporting layer comprising a first group of pocketed coils defining a perimeter of the pocket coil layer and a second group of pocketed coils, where the first group of pocketed coils includes a first fabric and the second group of pocketed coils includes a second fabric, a base layer positioned adjacent the pocketed coil layer, a fan operably connected to an inlet hole of the base layer, the fan for providing air flow into the inlet hole of the base layer; supplying an electrical current to the fan such that the fan pushes a volume of air at a preselected velocity into the inlet hole of the base layer; and moving the volume of air from the inlet hole of the base layer through the second group of pocketed coils of the pocketed coil layer and out of the first surface of the body supporting layer Further features and advantages of the present invention will become evident to those of ordinary skill in the art after a study of the description, figures, and non-limiting examples in this document.

BRIEF DESCRIPTION OF THE DRAWINGS

FIG. 5A illustrates a foam component disposed on top of a coil; FIG. 5B illustrates a foam component disposed below a coil.

DESCRIPTION OF EXEMPLARY EMBODIMENTS

Support cushions and in particular, mattress assemblies, may make use of a pocketed coil support layer. The pocketed coil support layer described herein may include a plurality of materials (e.g. air permeable fabrics and air impermeable fabrics) to direct the movement of air to the surface(s) of the support cushions. Therefore, the support cushions described herein may allow a user to individualize their level of comfort, including sleep comfort, by controlling the amount and/or temperature of the air flowing to the surface of the support cushions.

Figure 1:
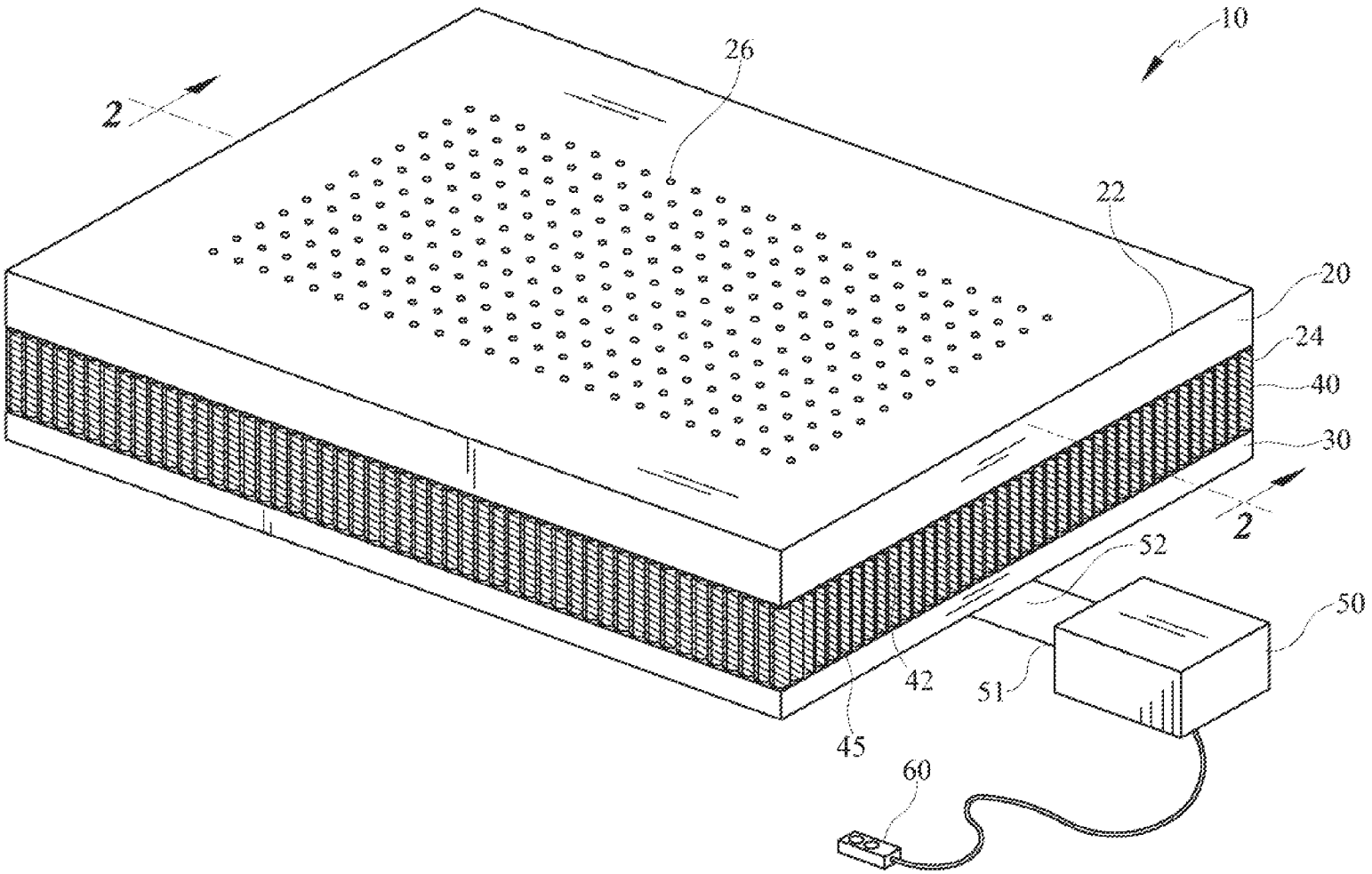
FIG. 1 is a perspective view of an exemplary embodiment of a support cushion, in the form of a mattress assembly described herein.
Figure 2:
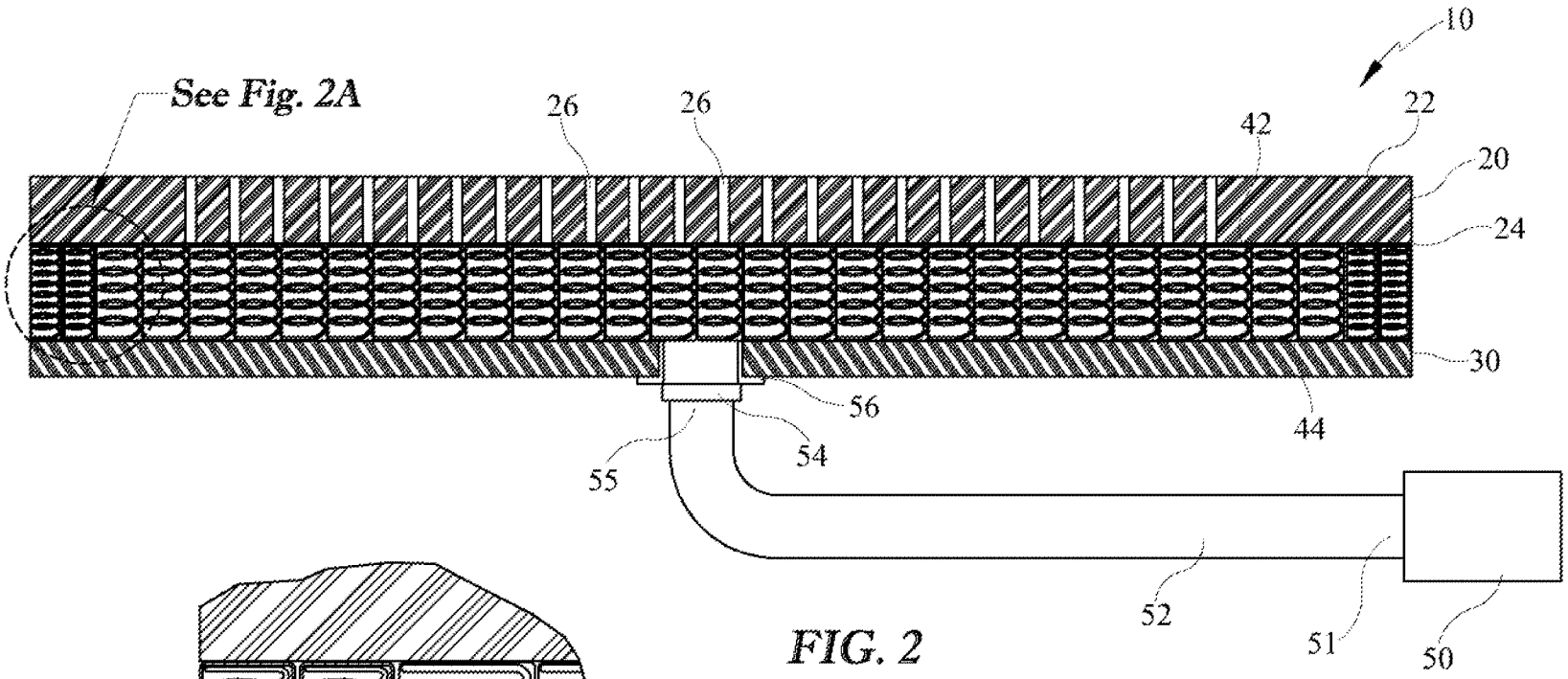
FIG. 2 is a cross-sectional view of the exemplary embodiment of the mattress assembly of FIG. 1 taken along line 2-2 of FIG. 1.
Figure 3:
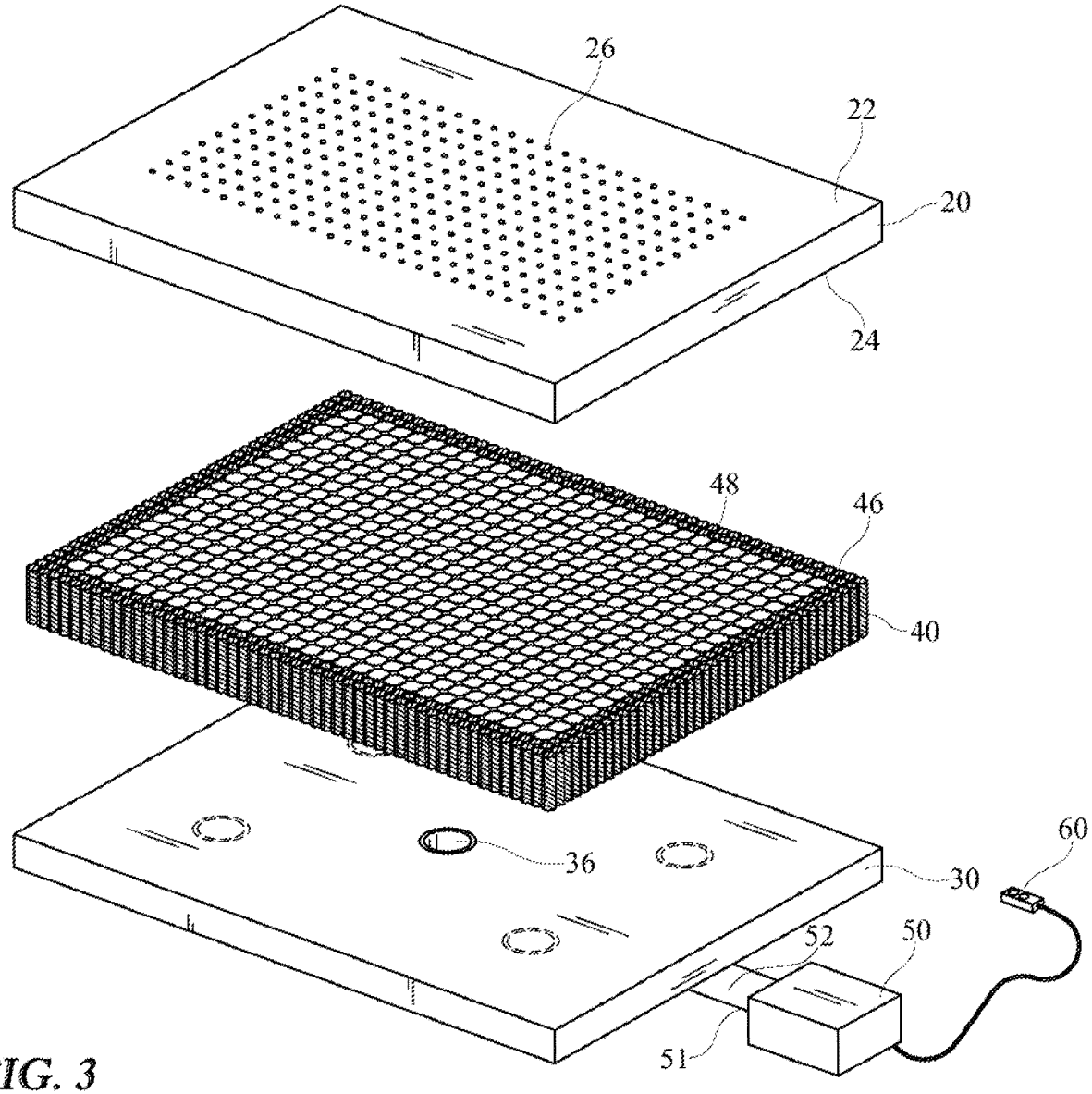
FIG. 3 is an exploded, perspective view of the exemplary embodiment of the mattress assembly of FIG. 1.

Referring first to FIGS. 1-3, in one exemplary embodiment of the present disclosure, a support cushion in the form of a mattress assembly 10 is illustrated, where the mattress assembly includes a body supporting layer 20 having a first surface 22 and a second surface 24 opposite the first surface 22. The mattress assembly 10 further includes a pocketed coil layer 40 positioned adjacent to the second surface 24 of the body supporting layer 20 and configured to support the body supporting layer 20. The pocketed coil layer 40 includes an upper portion 42 and a lower portion 45. Finally, the mattress assembly further includes a base layer 30 positioned adjacent to the lower portion 45 of the pocketed coil layer 40.

The base layer 30, which may take the form of a flexible (including foam) platform structure to allow for use on an adjustable base, or a hard bottom, platform structure, or the like, provides a support surface upon which the pocketed coil layer 40 may sit. In some embodiments, the base layer 30 may be substantially flat and stationary; while in other embodiments, the base layer 30 may be adjustable and capable of moving from a substantially flat position to any number of inclined positions as desired by a user and known in the art. In embodiments, where the base is adjustable, the mattress assembly 10 may also have locating features for aligning the mattress assembly 10 and an adjustable base (not shown). As perhaps best illustrated in FIG. 3, the base layer 30 may also define at least one opening or an inlet hole 36, as discussed further below. It is to be understood that although the embodiment illustrated in FIGS. 1-3 contains only a single inlet, this is not intended to be limiting. In some embodiments, there may be multiple inlets 36 positioned in various locations of the base layer 30; in other embodiments, there may be one or more inlets 36 per zone (zones are discussed in detail herein). These multiple inlets 36 are represented by broken line holes.

Figure 2A:
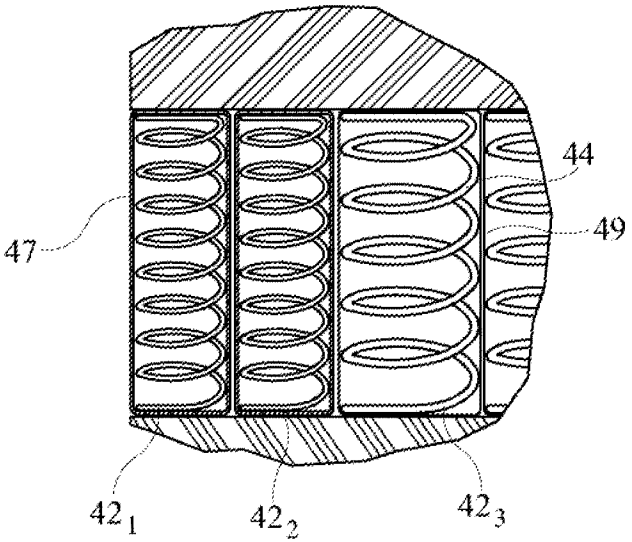
FIG. 2A is an enlarged view of a portion of the cross-sectional view of FIG. 2.

Referring now to FIGS. 2, 2A, and 3, the pocketed coil layer 40 includes a plurality of individually "pocketed" coils $\mathbf{42}_{1\text{-}n}$. Each individually pocketed coil $\mathbf{42}_{1\text{-}n}$ may comprise a spring or coil 44 wrapped or encased within a fabric cover 47. This cover 47 may be known in the art as a spacer fabric, and may be permeable. In some instances, the spacer fabric comprising the cover 47 may be formed of a bi-directionally stretched material, meaning it is stretchable in two dimensions, such as the horizontal directions, for example head to toe and laterally, side to side relative a bed. The spacer fabric may include a woven, or knit material, and/or may include extruded plastic materials including polyethylene, polyester, other plastics or combinations of any of these or others. These individually pocketed coils $\mathbf{42}_{1\text{-}n}$ may then be arranged in rows or columns within a perimeter and sewn together to form a cohesive unit, for example the pocketed coil layer 40. In some embodiments, the rows and columns are aligned such that each row forms a straight line and each column forms a straight line. In other embodiments, the rows and columns are arranged so as to be offset from each other, for example forming a checkerboard-like pattern. The use of pocketed coils or a pocketed coil layer may provide for a more comfortable mattress surface as the coils become relatively individually flexible, so that each coil may flex separately without affecting the neighboring coils.

Figure 5B:
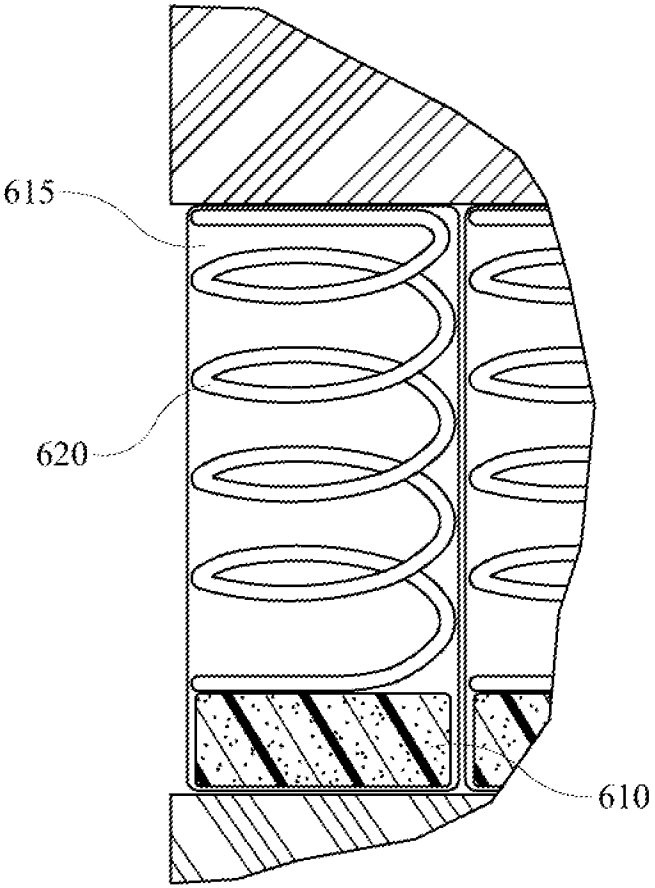
FIG. 5A-B are enlarged cross-sectional views of another exemplary embodiment of a mattress assembly.
Figure 5A:
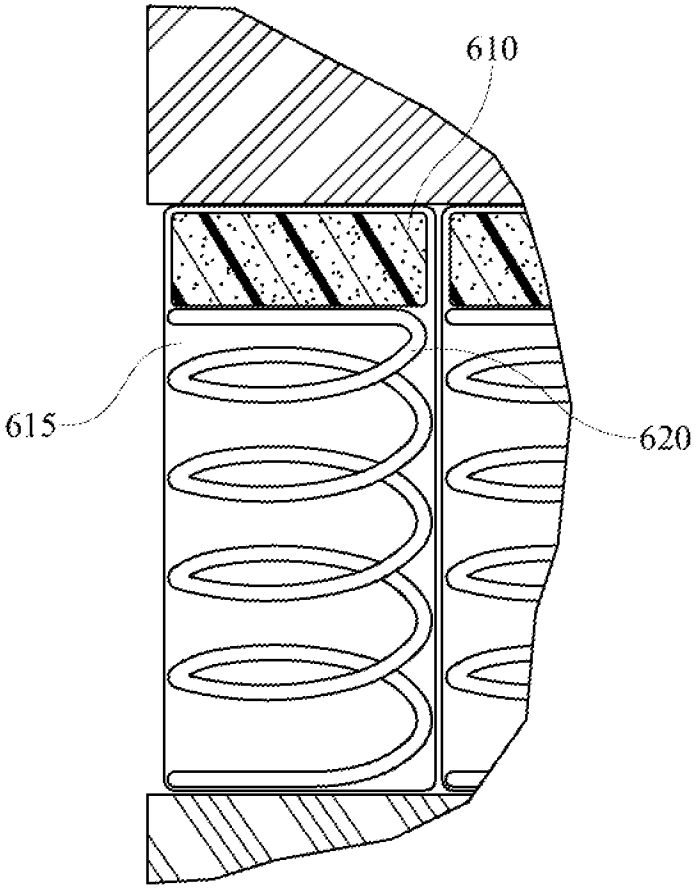

In some embodiments, the springs or coils 44 may be constructed of a steel wire, high carbon spring wire, high carbon piano wire, cooper coated high carbon wire, aluminum coated high carbon wire, cold drawn upholstery wire types "A", "B", or "C", or any other types of wire known in the art. The wire used in the construction of the springs or coils 44 may range between 12 and 20 gauge. In other embodiments, the springs or coils may be constructed of a polymer material, for example plastic or polyurethane. In some embodiments, the springs or coils 44 may range in diameter from about 10 millimeters to about 150 millimeters. The raw height of the springs or coils 44 may range from about 0.5 inches to about 12 inches, and the height or the spring or coil in the pocket may also range from about 0.5 inches to about 12 inches. In some embodiments, the spring or coil 44 preload ranges from 0 to 5 pounds of force, and spring rate ranges from 0.25 to 5.0 pounds of force per inch. In some embodiments, the coil geometry may be linear compression; while in other embodiments the coil geometry may be variable compression, linear cylindrical, or variable diameter in order to achieve variable compression. In some embodiments, such as illustrated in FIGS. 5A-B, foam 610 of any variety described herein may also be used within the pockets 615. For example, FIG. 5A illustrates the foam 610 disposed on top of the coil 620; while, FIG. 5B illustrates the foam 610 disposed below the coil.

Referring still to FIGS. 2 and 3, the mattress assembly 10 further includes an air flow unit, here shown generally as a box 50, which is operably connected to the inlet hole 36 of the base layer 30 by way of a conduit 52. In some instances the air flow unit 50 may be embodied by a fan, although it is not so limited. In other instances, the air flow unit 50 may be an air pump, a blower, or a compressor. Specifically, as shown in FIG. 2, a flange 56 is operably connected to and extending through the inlet hole of the base layer 30. The conduit 52 further includes a proximal end 51 and a distal end 55, where the distal end 55 includes a connector 54 that is configured to engage the flange 56 in order to provide fluid communication between the air flow unit 50 and the pocketed coil layer 40 through the inlet 36 of the base layer 30. The conduit 52 may be rigid or may be flexible and may be formed of a variety of materials. The conduit 52 is shown schematically and may be of a length so that the air flow unit 50 is located under the mattress assembly 10 or may extend beyond the periphery of the mattress assembly 10.

With respect to the air flow unit 50, although not expressly shown, the air flow unit 50, which in some instances may be embodied by a fan, provides air flow into the interior of the pocketed coil layer 40 by way of one or more conduits 52. It is known that as a user contacts a mattress assembly the temperature and/or humidity of the air nearest the surface of the mattress may increase due to dissipation of heat and/or moisture from the user's body. In some embodiments, air flowing into the pocketed layer 40 may be ambient air that is solely moved by the air flow unit. Such movement may function to flush out warmer and/or higher humidity air from the area where the user contacts the mattress assembly. In other embodiments, air flowing into the pocketed layer 40 may be conditioned, for example by removing moisture from the air, in order to improve the humidity level of the air nearest where the user contacts the mattress assembly.

In still other embodiments, the air flow unit 50 may further include a heating unit, a cooling unit, or both a heating and cooling unit in order to provide thermally controlled air flow into the pocketed coil layer 40. In such embodiments the air flowing into the pocketed layer 40 may be heated and/or cooled, for example to a user selected temperature. In such in embodiments, the user selected temperature may range from between about 15 degrees C. and 35 degrees C.

As best illustrated in FIG. 3, the pocketed coil layer 40 in the exemplary embodiment shown in FIGS. 1-3 includes a first group of pocketed coils 46 that define a perimeter of the pocketed coil layer 40 and a second group of pocketed coils 48 that may include at least a portion of the interior section of the pocketed coil layer 40. As illustrated, this first group of pocketed coils 46 vary in size from the second group of pocketed coils 48. In some embodiments, the individual pocketed coils $\mathbf{42}_{1\text{-}n}$ of the first group 46 may have a smaller diameter than the individual pocketed coils $\mathbf{42}_{1\text{-}n}$ of the second group 48. The smaller diameter coils along the perimeter of the pocketed coil layer 40 may, in some instances, be desirable to increase stiffness around the perimeter, which may increase the aesthetic appearance and longevity of the pocketed coil layer 40. However, this is not intended to be limiting, as the first group of pocketed coils may be any size desirable or known in the art, and further may or may not be the same size as the individual coils $\mathbf{42}_{1\text{-}n}$ of the second group of coils 48. Although only a single size is shown, in some embodiments, the outermost coils (e.g. those that define the perimeter) may be of two or more different diameters in order to provide a desired stiffness. The size and/or diameter of both the outermost coils (e.g. those that define the perimeter) as well as the interior coils should not be limiting, as design characteristics of the mattress may dictate variation in size and shape.

Returning now to FIG. 2A, as previously mentioned, each individually pocketed coil $\mathbf{42}_{1\text{-}n}$ may comprise a spring or coil 44 wrapped or encased within a cover or spacer fabric 47. Conventionally, this cover or spacer fabric is a fabric material, and conventionally the same type of fabric material is utilized to encase each of the individual pocketed coils $\mathbf{42}_{1\text{-}n}$. The individual pocketed coils of the first 46 and second 48 groups of pocketed coils in the exemplary embodiment shown in FIGS. 1-3 are encased in different materials; for example, in some instances, the individual pocketed coils $\mathbf{42}_{1\text{-}n}$ of the first group of pocketed coils 46 are encased in a first type of material 47, while the individual pocketed coils $\mathbf{42}_{1\text{-}n}$ of the second group of pocketed coils 48 are encased in a second type of material 49. The first material 47 may be a substantially air impermeable material. In some embodiments, this first material 47 may be an impermeable fabric, such as certain non-woven fabrics, fabrics with a urethane backing, and/or knit fabrics backed with thermoplastic polyurethane (TPU) (for example, the Tempur-Pedic® Mattress Protector); however, this is not intended to be limiting, in other embodiments, the first material 47 may be an impermeable plastic, or some other flexible impermeable material. The second material 49 may be a substantially air permeable material. In some embodiments, this second material 49 may be a permeable fabric, such as certain non-woven fabrics, woven fabrics, and/or knit fabric; however, this is not intended to be limiting as any other flexible permeable material may be used. When used herein, the term "impermeable" is used herein to generally refer to a material which substantially prevents the movement of air through the material, including materials that are "low permeable" and may allow some vapor to escape; similarly, the use of the term "permeable" herein generally refers to a materially which substantially allows the movement of air through the material. ASTM Standard D737-04 "Test Method for Air Permeability of Textile Fabrics" is utilized in evaluating materials and classification of materials as permeable or impermeable.

Encasing the individual pocketed coils $\mathbf{42}_{1-n}$ of the first group of pocketed coils 46 in an air impermeable material 47 and the second group of pocketed coils 48 in an air permeable material 49 may allow air flow to be directed in to one or more desired locations of the mattress assembly 10. For example, the air flowing into the pocketed coil layer 40 from the inlet 36 of the base layer 30 cannot readily escape through the first group of pocketed coils 46 defining the perimeter of the pocketed coil layer 40 as they encased in an air impermeable material 47. This air impermeable material 47 forms a boundary or an envelope for air moving into and within the pocketed coil layer 40. Furthermore, the air cannot readily escape the base layer 30. Therefore, a substantial portion of the air flowing into the pocketed coil layer 40 will flow into the second group of coils 48, which are encased in an air permeable material 49, and ultimately through this second group of coils and through the overlying body supporting layer 20. Further, while the impermeable material 47 is shown along the boundary, it may also be used to define zones for air flow.

To this end, and referring now to FIG. 2 in particular, the body supporting layer 20 may include a plurality of channels 26 that extend from the second surface 24 to the first surface 22. In some embodiments, this plurality of channels 26 may substantially align with the second group of pocketed coils 48 encased in an air permeable material 49, allowing air to flow through the second group of pocketed coils 48 to the first surface 22 of the body supporting layer 20 through the plurality of channels 26.

Although the channels 26 are illustrated in FIGS. 1-3 as having consistent density in either direction of the body supporting layer 20, in some embodiments it may be desirable for the density to be varied. For example, the may be desirable to increase air flow in at an upper portion of the body supporting layer (e.g. the torso area) but decrease the air flow at other portions of the body supporting layer (e.g. the head and feet areas); in such an example the channels 26 corresponding to the upper portion of the body supporting layer (e.g. the torso area) may be more dense, while the channels 26 corresponding to other portions of the body supporting layer (e.g. the head and feet areas) are less dense. Thus, in some embodiments, the density of the channels may vary to support a desired air flow configuration. Furthermore, as a user lays on the mattress assembly, the body supporting layer 20 may depress resulting in the slight closure or blockage of one or more channels 26, but air flow may still continue through other channels 26.

In some embodiments, the second surface 24 of the body support layer 20 may also be substantially air impermeable. In some embodiments, air impermeability of the second surface 24 of the body support layer 20 may be achieved by sealing the second surface. In some embodiments, this sealing may be accomplished by using a layer of air impermeable material or a layer of a low permeable material (e.g. thermoplastic polyurethane (TPU)) that is sealed using heat or ultrasonic techniques. This sealing may also be achieved by other means known in the art. In other embodiments, the second surface remains unsealed altogether.

With respect to the body supporting layer 20, in the exemplary embodiment shown in FIGS. 1-3, the body supporting layer 20 of the mattress assembly 10 is comprised of a continuous layer of flexible foam for suitably distributing pressure from a user's body or portion thereof across the body supporting layer 20. Such flexible foams include, but are not limited to, latex foam, reticulated or non-reticulated visco-elastic foam (sometimes referred to as memory foam or low-resilience foam), reticulated or non-reticulated non-visco-elastic foam, polyurethane high-resilience foam, expanded polymer foams (e.g., expanded ethylene vinyl acetate, polypropylene, polystyrene, or polyethylene), and the like. In the embodiment shown in FIGS. 1-3, the body supporting layer 20 is comprised of a visco-elastic foam that has a low resilience as well as a sufficient density and hardness, which allows pressure to be absorbed uniformly and distributed evenly across the body supporting layer 20 of the mattress assembly 10. Generally, such visco-elastic foams have a hardness of at least about 10 N to no greater than about 80 N, as measured by exerting pressure from a plate against a sample of the material to a compression of at least 40% of an original thickness of the material at approximately room temperature (i.e., 21° C. to 23° C.), where the 40% compression is held for a set period of time as established by the International Organization of Standardization (ISO) 2439 hardness measuring standard. In some embodiments, the visco-elastic foam has a hardness of about 10 N, about 20 N, about 30 N, about 40 N, about 50 N, about 60 N, about 70 N, or about 80 N to provide a desired degree of comfort and body-conforming qualities.

The visco-elastic foam described herein for use in the mattress assembly 10 can also have a density that assists in providing a desired degree of comfort and body-conforming qualities, as well as an increased degree of material durability. In some embodiments, the density of the visco-elastic foam used in the body supporting layer 20 has a density of no less than about 30 kg/m$^3$ to no greater than about 150 kg/m$^3$. In some embodiments, the density of the visco-elastic foam used in the body supporting layer 20 of the mattress assembly 10 is about 30 kg/m$^3$, about 40 kg/m$^3$, about 50 kg/m$^3$, about 60 kg/m$^3$, about 70 kg/m$^3$, about 80 kg/m$^3$, about 90 kg/m$^3$, about 100 kg/m$^3$, about 110 kg/m$^3$, about 120 kg/m$^3$, about 130 kg/m$^3$, about 140 kg/m$^3$, or about 150 kg/m$^3$. Of course, the selection of a visco-elastic foam having a particular density will affect other characteristics of the foam, including its hardness, the manner in which the foam responds to pressure, and the overall feel of the foam, but it is appreciated that a visco-elastic foam having a desired density and hardness can readily be selected for a particular application or mattress assembly as desired. Additionally, it is appreciated that the body supporting layers of the mattress assemblies need not be comprised of a continuous layer of flexible foam at all, but can also take the form of more traditional mattresses, including spring-based mattresses, without departing from the spirit and scope of the subject matter described herein.

In the embodiments shown in FIGS. 1-3, the pocketed coil layer 40 is arranged so that there is a single "zone" of the second group of pocketed coils 48, which are pocketed in an air permeable material. Such an arrangement creates a single zone where air can flow through the pocketed coil layer 40 and into and through the plurality of channels 26 that extend from the second surface 24 to the first surface 22 of the body supporting layer 20. However, it is contemplated that in some instances other arrangements may be desirable. Non-limiting examples of some of these contemplated arrangements are illustrated in FIGS. 4A and 4B.

Figure 4A:
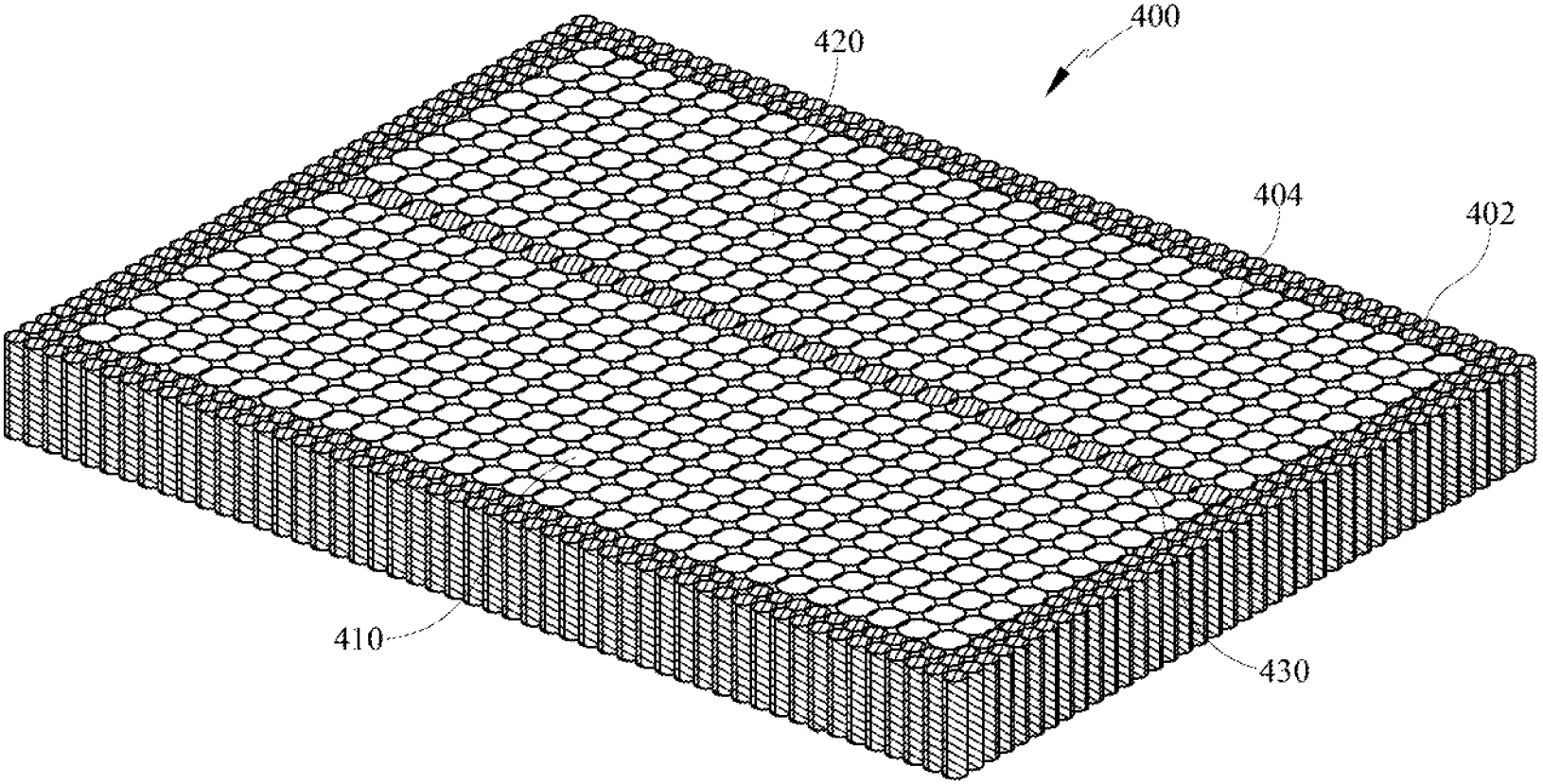
FIG. 4A-B are perspective views of additional embodiments of pocketed coil layers described herein.

Referring now to FIG. 4A, another embodiment of a pocketed coil layer 400 disclosed herein is illustrated. The embodiment illustrated in FIG. 4A, similar to the embodiment illustrated in FIGS. 1-3, includes a first group of pocketed coils 402 defining a perimeter of the pocketed coil layer 400 and a second group of pocketed coils 404. Also similar to the embodiments described above, the individual coils of the first group of pocketed coils 402 are encased in an air impermeable material and the individual coils of the second group of pocketed coils 404 are encased in an air permeable material. However, unlike the embodiment described in FIGS. 1-3, the pocketed coil layer 400 illustrated in FIG. 4A is divided into a first zone 410 and a second zone 420. These zones 410, 420 are created by a third group of pocketed coils 430 extending between two opposing sides of the perimeter defined by the first group of pocketed coils 402. The individual coils of the third group of pocketed coils 430 are also encased in an air impermeable material such as described herein, creating a barrier to air flow between the first zone 410 and the second zone 420. The third group of pocketed coils 430 is illustrated in FIG. 4A as extending between the two longer sides of the perimeter, which may create a different zone for each user of the overall mattress assembly. However, this is not intended to be limiting, as the third group of pocketed coils 430 may extended between any two sides of the perimeter to create desirable zones.

Figure 4B:
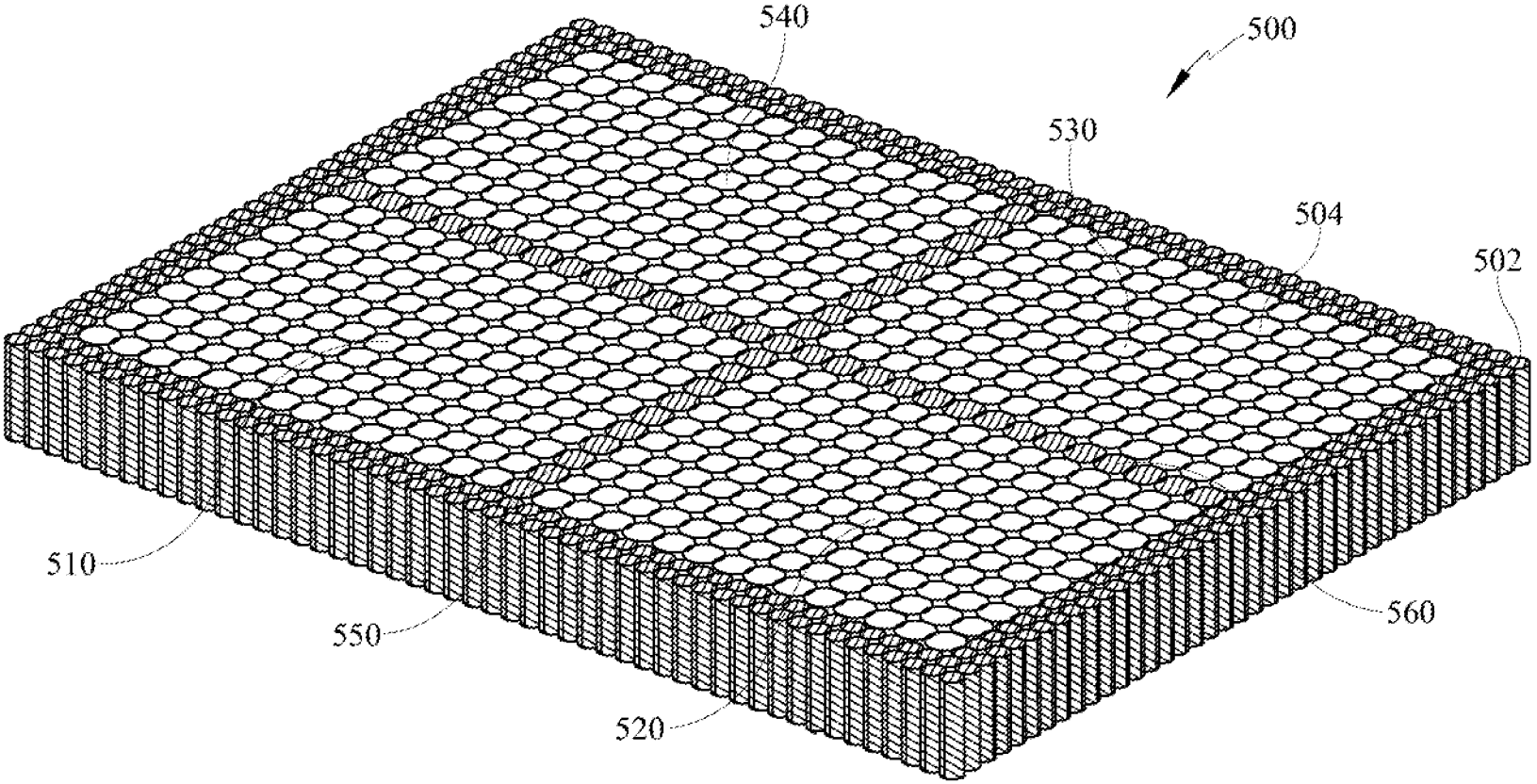

FIG. 4B illustrates an additional embodiment of a pocketed coil layer 500, which includes a first group of pocketed coils 502 defining a perimeter of the pocketed coil layer 500 and a second group of pocketed coils 504. The individual coils of the first group of pocketed coils 502 are encased in an air impermeable material and the individual coils of the second group of pocketed coils 504 are encased in an air permeable material. However, unlike the embodiment described in FIG. 4A, the pocketed coil layer 500 illustrated in FIG. 4B is divided into a four zones: first zone 510, a second zone 520, a third zone 530, and a fourth zones 540. These zones 510, 520, 530, 540 are created by the perpendicular intersection of a third group of pocketed coils 550 and a fourth group of pocketed coils 560. Each of the third 550 and the fourth 560 groups of pocketed coils extend between opposing sides of the perimeter of the pocketed coil layer defined by the first group of pocketed coils 502. The individual coils of the third 550 and fourth groups 560 of pocketed coils are encased in an air impermeable material such as described herein, creating a barrier to air flow between the first zone 510, second zone 520, third zone 530, and fourth zone 540. In some embodiments, the pattern and/or density of the channels 26 may also vary in order to improve the control of the flow of air.

As a further refinement, the mattress assembly may further include a controller 60 for controlling the air flow unit which provides the air flow to the first surface of the body supporting layer. By including a controller in the mattress assembly, not only can the amount and/or velocity of air flow be controlled, but, in some embodiments, the temperature of the air flow may also be controlled to provide a desired amount of heating and/or cooling at the first surface of the body supporting layer of the mattress assembly. In some embodiments the controller may be wired; while in other embodiments, the controller may be wireless.

As illustrated in FIG. 4A-B, the additional groups of pocketed coils 430, 550, 560 may create barriers to air flow between their respective zones 410, 420, 510, 520, 530, 540 of the pocketed coil layer 400, 500. Because of these barriers, a user may further control and customize their experience to tailor their specific thermocomfort desires. In some embodiments, a user may control the temperature and/or air flow from one or more fans to each of the zones 410, 420, 510, 520, 530, 540 created by the plurality of groups of pocketed coils independent of each other.

For example, in some embodiments, as illustrated in FIG. 4A, the zones may be configured such that there is a zone for each bedmate, allowing each individual bedmate to independently control the temperature and/or airflow to their portion of the mattress assembly. In other embodiments, the pocketed coil layer may be "zoned" so has to create a zone for controlling the temperature and/or airflow to the lower portion (e.g. a feet portion) of the mattress assembly and a zone for controlling the temperature and/or airflow to the upper portion (e.g. a head portion) of the mattress assembly.

As an additional example, in other embodiments, such as illustrated in FIG. 4B, zones may be configured such that there is a zone for each bedmate's upper portion (e.g. a head portion) and each bedmate's lower portion (e.g. a feet portion), allowing each individual bedmate to independently control the temperature and/or airflow to their portions of the mattress assembly.

As a refinement, although in the embodiments shown in FIGS. 1-3, the air flow unit 50 is connected by the conduit 52 such that the air flow unit 50 is positioned a distance away from the rest of the mattress assembly 10, other positions are contemplated including mounting the air flow unit 50 to the base layer 30 and/or within the confines of the support cushion assembly 10.

As an additional refinement, and although not shown in the figures, additional components or layers may also be included with the mattress assembly of the present invention. For example, in some embodiments, the body supporting layer of the mattress assembly is further covered by a comfort portion or layer that is positioned atop the body supporting layer and provides an additional level of comfort to a body of a user or a portion of thereof that is resting on the mattress assembly. Such a comfort layer may also be comprised of a visco-elastic foam. However, the comfort layer typically has a density, hardness, or both that is less than that of the body supporting layer of the mattress assembly, such that the comfort layer provides a softer surface on which to rest the body of a user or a portion thereof.

As a further refinement, and in order to ensure that fresh air is entering the base layer, the mattress assembly may further include a filter, such that only filtered air is allowed to pass into the inlet hole, and that the pocketed coil layer is kept free of particulates such as smoke, dust, dirt, pollen, mold, bacteria, hair, or insects that may otherwise collect in the interior of the mattress and limit air flow. Of course, it is contemplated that various types of filters including, but not limited to, charcoal filters for removing chemicals and/or unpleasant odors may be readily incorporated into an exemplary mattress of the present invention without departing from the spirit and scope of the subject matter described herein. In some embodiments, it is further contemplated that one or more air fresheners and/or perfumes may further be added to the mattress assemblies (e.g., before the fan) in order that scented air may be directed to the surface of the support cushion assemblies.

Each of the exemplary support cushions and/or mattress assemblies described herein can also be used as part of a method of controlling air flow through a support cushion. In some implementations, a method of controlling air flow through a support cushion includes first providing a support cushion of the present invention. Electrical current is then supplied to the air flow unit such that the fan of the air flow unit pushes a preselected volume of air into the inlet hole of the base layer. In some embodiments, the volume of air may range from 0.0 to about 2.0 cubic meters per minute. In some embodiments a user may select the desired volume of air to be delivered, while in other embodiments, the volume may be preselected. The adjustability in the volume of air flowing from the air flow unit may be accomplished a variety ways. For example, in some embodiments, this may be accomplished by varying the speed of a fan within the air flow unit in response to a user input. In other embodiments, this may be accomplished by altering the pitch of the blades of a fan within the air flow unit in response to a user input. In still other embodiments, this may be accomplished by altering the voltage supplied to a motor of the air flow unit in response to a user input.

The volume of air is then moved from the inlet hole of the base layer through a group of coils of the pocketed coil layer, where each of the individual coils of this group of pocketed coils are encased in an air permeable material, and out of the first surface of a body supporting layer. For embodiments where the air flow unit includes a heating unit and/or a cooling unit, electrical current may also be supplied to the heating and/or cooling unit such that the temperature of the air flowing out of the first surface of the body supporting layer may be adjusted, for example based on a user input to a controller.

One of ordinary skill in the art will recognize that additional embodiments are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. A support cushion, comprising:

a body supporting layer having a first surface and a second surface opposite the first surface;

a pocketed coil layer adjacent the second surface of the body supporting layer comprising a first group of pocketed coils defining a perimeter of the pocketed coil layer and a second group of pocketed coils positioned within the perimeter;

a base layer positioned adjacent the pocketed coil layer;

a fan operably connected through a conduit to an inlet hole of the base layer, the fan for providing air flow into the inlet hole of the base layer, wherein the air flow is directed from the inlet hole of the base layer into the pocketed coil layer, through the second group of pocketed coils, and into and through the body supporting layer;

wherein the first group of pocketed coils includes a first fabric that is substantially air impermeable such that the first group of pocketed coil springs defines an air envelope within the pocketed coil layer; and wherein the second group of pocketed coils includes a second fabric that is substantially air permeable such that air flow directed from the inlet hole of the base layer into the pocketed coil layer spreads within the air envelope before flowing into and through the body supporting layer.

2. The support cushion of claim 1, wherein the body supporting layer defines a plurality of channels extending from the second surface to the first surface, the plurality of channels substantially aligned with the second group of pocketed coils.

3. The support cushion of claim 1, wherein the second group of pocketed coils are located in an interior section of the pocketed coil layer.

4. The support cushion of claim 1, wherein the body supporting layer is comprised of a visco-elastic foam.

5. The support cushion of claim 1, wherein the air flow is comprised of ambient air.

6. The support cushion of claim 1, wherein the fan is disposed within an air flow unit, said air flow unit further comprising a heating unit, a cooling unit, or both a heating unit and a cooling unit configured to provide thermally controlled air flow into the inlet hole of the base layer into the pocketed coil layer, through the second fabric of the second group of pocketed coils, and into and through the body supporting layer.

7. The support cushion of claim 1, further comprising a third group of pocketed coils intersecting the perimeter defined by the first group of pocketed coils, wherein the third group of coils divides the pocketed coil layer into two zones.

8. The support cushion of claim 7, wherein the third group of pocketed coils laterally intersects the perimeter defined by the first group of pocketed coils, wherein the third group of pocketed coils includes a first fabric that is substantially air impermeable.

9. The support cushion of claim 7, wherein the third group of pocketed coils longitudinally intersects the perimeter defined by the first group of pocketed coils, wherein the third group of pocketed coils includes a first fabric that is substantially air impermeable.

10. The support cushion of claim 7, further comprising a fourth group of pocketed coils intersecting the perimeter defined by the first group of pocketed coils at an opposing axis to the third group of pocketed coils, wherein the third and fourth groups of coils include a first fabric that is substantially air impermeable and divide the pocketed coil layer into four zones.

11. The support cushion of claim 1, wherein an individual pocketed coil of the first group of pocketed coils has a different diameter than an individual pocketed coil of the second group of pocketed coils.

12. The support cushion of claim 11, wherein the individual pocketed coil of the first group of pocketed coils has a smaller diameter than the individual pocketed coil of the second group of pocketed coils.

13. A mattress assembly, comprising:

a body supporting layer comprised of visco-elastic foam and having a first surface and a second surface opposite the first surface, the body supporting layer defining a plurality of channels extending from the second surface to the first surface;

a pocketed coil layer adjacent the second surface of the body supporting layer comprising a first group of pocketed coils defining a perimeter of the pocketed coil layer and a second group of pocketed coils, wherein the first group of pocketed coils includes a first fabric, wherein the first fabric is substantially air impermeable, wherein the second group of pocketed coils includes a second fabric, wherein the second fabric is substantially air permeable;

an impermeable base layer positioned adjacent the pocketed coil layer;

a fan operably connected to an inlet hole of the base layer, the fan for providing air flow into the inlet hole of the base layer, wherein the air flow is directed from the inlet hole of the base layer into the pocketed coil layer, through the second fabric of the second group of pocketed coils, and into and through the body supporting layer; and wherein the first group of pocketed coils prevents air flowing out of the pocketed coil layer except through the body supporting layer.

14. The mattress assembly of claim 13, further comprising a third group of pocketed coils intersecting the perimeter defined by the first group of pocketed coils, wherein the third group of coils divides the pocketed coil layer into two sections.

15. The mattress assembly of claim 14, wherein the third group of pocketed coils laterally intersects the perimeter defined by the first group of pocketed coils.

16. The mattress assembly of claim 14, wherein the third group of pocketed coils longitudinally intersects the perimeter defined by the first group of pocketed coils.

17. The mattress assembly of claim 14, further comprising a fourth group of pocketed coils intersecting the perimeter defined by the first group of pocketed coils at an opposing axis to the third group of pocketed coil, wherein the third and fourth groups of coils divide the pocketed coil layer into four sections.

18. A method of controlling air flow through a support cushion, comprising the steps of:

providing a support cushion having a body supporting layer having a first surface and a second surface opposite the first surface, a pocketed coil layer adjacent the second surface of the body supporting layer comprising a first group of pocketed coils defining a perimeter of the pocketed coil layer and a second group of pocketed coils, wherein the first group of pocketed coils includes a first fabric and the second group of pocketed coils includes a second fabric, a base layer positioned adjacent the pocketed coil layer, and a fan operably connected to an inlet hole of the base layer, the fan for providing air flow into the inlet hole of the base layer;

supplying an electrical current to the fan such that the fan pushes a volume of air at a preselected velocity into the inlet hole of the base layer; and moving the volume of air from the inlet hole of the base layer through the second group of pocketed coils of the pocketed coil layer and out of the first surface of the body supporting layer, wherein the first fabric of the first group of pocketed coils is substantially air impermeable and the second fabric of the second group of pocketed coils is substantially air permeable, such that the first group of pocketed coils prevents air flowing out of the pocketed coil layer except through the body supporting layer.

* * * * *